US007077191B2

(12) United States Patent
Merkle

(10) Patent No.: US 7,077,191 B2
(45) Date of Patent: Jul. 18, 2006

(54) MEANS FOR MAINTAINING THE SURFACE TEMPERATURE OF A PLAYGROUND STRUCTURE WITHIN AN ERGONOMICALLY ACCEPTABLE RANGE

(75) Inventor: Denise Lynn Merkle, Fort Worth, TX (US)

(73) Assignee: SciConsult, Inc., Ft. Worth, TX (US)

( * ) Notice: Subject to any disclaimer, the term of this patent is extended or adjusted under 35 U.S.C. 154(b) by 141 days.

(21) Appl. No.: 10/755,189

(22) Filed: Jan. 9, 2004

(65) Prior Publication Data

US 2004/0194911 A1 Oct. 7, 2004

Related U.S. Application Data

(60) Provisional application No. 60/439,176, filed on Jan. 10, 2003.

(51) Int. Cl.
*F28F 3/12* (2006.01)

(52) U.S. Cl. ..... 165/168; 165/45; 165/47; 62/260; 482/35

(58) Field of Classification Search ..... 165/45, 165/47, 48.1, 53, 168; 62/260; 405/36, 405/37, 43, 131, 258; 482/35
See application file for complete search history.

(56) References Cited

U.S. PATENT DOCUMENTS 2,947,109 A * 8/1960 Davis, Sr. et al. ..... 47/1.01 R
3,875,996 A * 4/1975 Von Kohorn et al. ..... 165/48.1
3,908,385 A * 9/1975 Daniel et al. ..... 405/37
4,023,506 A * 5/1977 Robey ..... 47/58.1 R
4,294,311 A * 10/1981 Denis et al. ..... 165/104.14
4,320,594 A * 3/1982 Raymond ..... 47/1.4
4,462,184 A * 7/1984 Cunningham ..... 47/58.1 R
4,714,108 A * 12/1987 Barry ..... 165/45
5,163,781 A * 11/1992 Husu ..... 405/43
5,257,039 A * 10/1993 Chung et al. ..... 347/237
5,368,092 A * 11/1994 Rearden et al. ..... 165/45
5,944,444 A * 8/1999 Motz et al. ..... 405/37
6,419,422 B1 * 7/2002 Wachtel ..... 405/36
6,467,535 B1 10/2002 Shembekar et al. ..... 165/140
6,470,570 B1 10/2002 Prater et al. ..... 29/890.053
6,470,703 B1 10/2002 Wada et al. ..... 62/509
6,470,964 B1 10/2002 Nakado et al. ..... 165/177

* cited by examiner

*Primary Examiner*—Terrell McKinnon
(74) *Attorney, Agent, or Firm*—John A. Fortkort; Fortkort Grether & Kelton LLP

(57) ABSTRACT

A playground structure 201 is provided herein which comprises at least one component 31 having a playing surface 41 thereon, and a heat exchange system adapted to modify the temperature of the playing surface. The heat exchange system may comprise a flow channel 35 disposed in the structure adjacent to the playing surface for the efficient regulation of the surface temperature thereof, a coolant disposed in the flow channel, and a pump 233 or other means for circulating the coolant through the flow channel.

18 Claims, 12 Drawing Sheets
(11 of 12 Drawing Sheet(s) Filed in Color)

- Prior Art -

MEANS FOR MAINTAINING THE SURFACE TEMPERATURE OF A PLAYGROUND STRUCTURE WITHIN AN ERGONOMICALLY ACCEPTABLE RANGE

CROSS-REFERENCE TO RELATED APPLICATIONS

This application claims priority from U.S. Provisional Application 60/439,176, which was filed on Jan. 10, 2003 and which is incorporated by reference herein in its entirety.

FIELD OF THE INVENTION

The devices and methodologies disclosed herein relate generally to playground structures, and more particularly to playground structures equipped with a means for regulating the surface temperature of playing surfaces thereon.

BACKGROUND OF THE INVENTION

Various playground structures are known to the art. Such structures are common features at schools, parks, recreation areas, and even many fast food establishments, and typically include a variety of surfaces that children can play on or interact with.

FIG. 1 depicts one example of a commercially available playground structure. The structure 11 includes a raised decking 13 that is equipped with railings 15, and that is supported on a series of posts 17. A variety of structures are accessible from the raised decking, including a first 19 and second 21 slide, a portico 23, a tube 25, and an observation bubble 27 set in a frame 29.

At present, many of the components of commercially available playground structures are made from various plastics. Thus, in the particular system depicted in FIG. 1, the decking 13, the first 19 and second 21 slide, the portico 23, the tube 25, and the frame 29 of the observation bubble 27 are all made from plastics. The use of plastics in playground structures is highly advantageous, due to their ability to be molded or extruded into a wide variety of shapes and colors. Plastics also have a high mechanical strength to weight ratio, and are very child-friendly.

However, the use of plastics in playground structures also has some drawbacks. Most notably, many plastics commonly used in this application absorb a significant amount of solar radiation, particularly infrared radiation. This is often true even if the constituent polymers of the plastic are themselves largely transparent to such radiation, because these plastics are, for aesthetic purposes, typically loaded with dyes and pigments that absorb substantial amounts of solar radiation. Consequently, playground structures made from these plastics often become hot to the touch when they are exposed to sunlight, especially in warmer climates. Under such conditions, these structures can be uncomfortable to use, and pose a risk of burns or other injuries. Excessive heating of playground structures under these conditions also tends to shorten the life of the structure.

Some attempts have been made in the art to deal with this issue. For example, many playground structures are provided with roofs or canopies to provide shading. However, such measures add significantly to the cost of the structure, and are often effective only when the sun is at certain angles or the structure is oriented in a particular direction. In many commercial settings, as with playground structures at fast food restaurants, the entire playground structure is housed indoors or within a stand-alone structure. However, this approach again adds significantly to the cost of the structure, and is not feasible for most playground settings.

There is thus a need in the art for a playground structure made out of plastics or other such commonly used materials, and which does not suffer from the aforementioned infirmities. In particular, there is a need in the art for a playground structure whose surface temperature can be maintained within an ergonomically acceptable range. These and other needs are met by the present invention, as hereinafter described.

SUMMARY OF THE INVENTION

In one aspect, the present invention relates to a playground structure comprising a component having a playing surface thereon, and a heat exchange system adapted to modify or regulate the surface temperature of said playing surface. The heat exchange system preferably comprises a channel disposed in the component through which a coolant, such as water, can flow. The channel, which is typically disposed adjacent to a playing surface for the efficient temperature regulation thereof, is preferably convoluted, and is also preferably in open communication with an inlet adapted to direct a fluid into the channel and an outlet adapted to direct a fluid out of the channel. The playground structure preferably comprises first and second components which are joined together across an interface, wherein the first and second components have first and second playing surfaces thereon, respectively, wherein the first and second components are equipped with first and second channels, respectively, which are adapted for the flow of a coolant through the component, and wherein the first and second channels are in open communication with each other via a fluid-tight seal. The playground structure may also comprise a pump adapted to circulate a coolant through the first and second components. In some embodiments, the pump may draw the coolant from a reservoir disposed beneath the playground structure. In some embodiments, the playground structure further comprises first and second nozzles which are in open communication with the first and second channels of the first and second components. These first and second nozzles may be connected via a portion of flexible tubing, and may be disposed within a longitudinal grove extending across the surfaces of the first and second components.

In another aspect, a component for a playground structure is provided, which comprises a body having a playing surface thereon, at least one channel extending through the body, the channel being adapted to transfer heat from the playing surface to a coolant disposed in the channel, an inlet adapted to direct a fluid into the at least one channel, and an outlet adapted to direct a fluid out of the at least one channel.

In yet another aspect, a method is provided herein for controlling the temperature of a playing surface on a playground structure. In accordance with the method, a component for a playground structure is provided which comprises (a) a body having a playing surface thereon, and (b) at least one channel extending through said body, said channel being adapted to transfer heat from said playing surface to a fluid disposed in said channel. The component may further comprise (c) an inlet adapted to direct a fluid into said at least one channel, and (d) an outlet adapted to direct a fluid out of said at least one channel. The temperature $T_{ps}$ of the playing surface is then monitored, and while $T_{ps}>T_k$, where $T_k$ is a predetermined strike temperature, a fluid is directed through the channel. The temperature $T_{ps}$ of the playing surface may be monitored by monitoring the temperature of a fluid disposed in, or flowing through, the channel.

These and other aspects of the present invention are described in further detail below.

DESCRIPTION OF THE FIGURES

The patent or application file contains at least one drawing executed in color. Copies of this patent or patent application publication with color drawing(s) will be provided by the Office upon request and payment of the necessary fee.

DETAILED DESCRIPTION

As used herein, the term "playing surface" refers to a surface suitable for use on a playground that a child can play upon or interact with. Non-limiting examples of playing surfaces include the functional surfaces of slides and decks.

Figure 17:
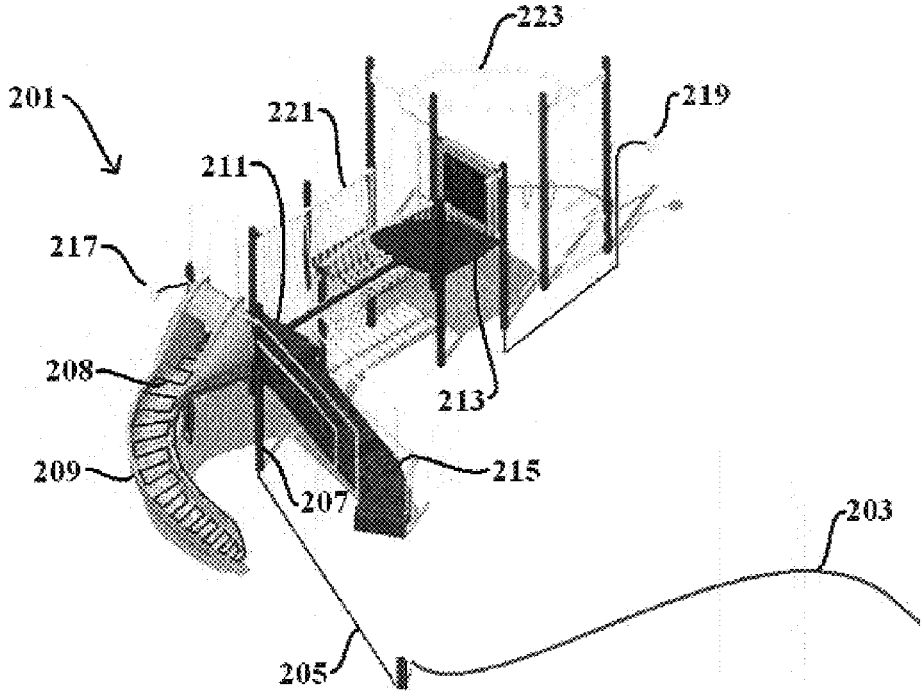
FIGS. 17 and 18 are perspective views of playground structures made in accordance with the teachings herein.
Figure 18:
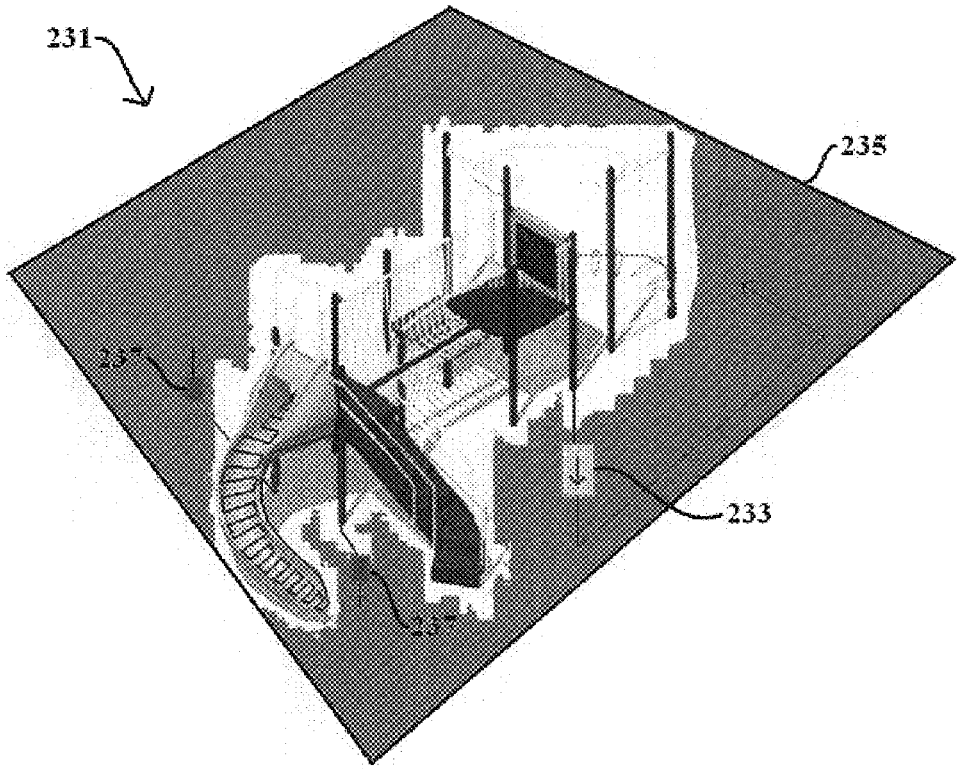

As used herein, the term "playground structure" refers to structures, such as those depicted in FIGS. 17 and 18, which are suitable for use on a playground and which contain a variety of playing surfaces for children to play upon or interact with.

As used herein, the term "component", when used in reference to a playground structure, refers to a portion of a playground structure having at least one playing surface thereon.

In the following description, like reference numerals in the figures refer to like elements.

In accordance with the present invention, a playground structure is provided which is equipped with a temperature maintaining means for maintaining the surface temperature of one or more playing surfaces of the structure within an ergonomically acceptable range. The temperature maintaining means is preferably a heat exchange system which circulates a liquid coolant through components of the playground structure such that the playing surfaces thereon are maintained within an ergonomically acceptable range.

Figure 1:
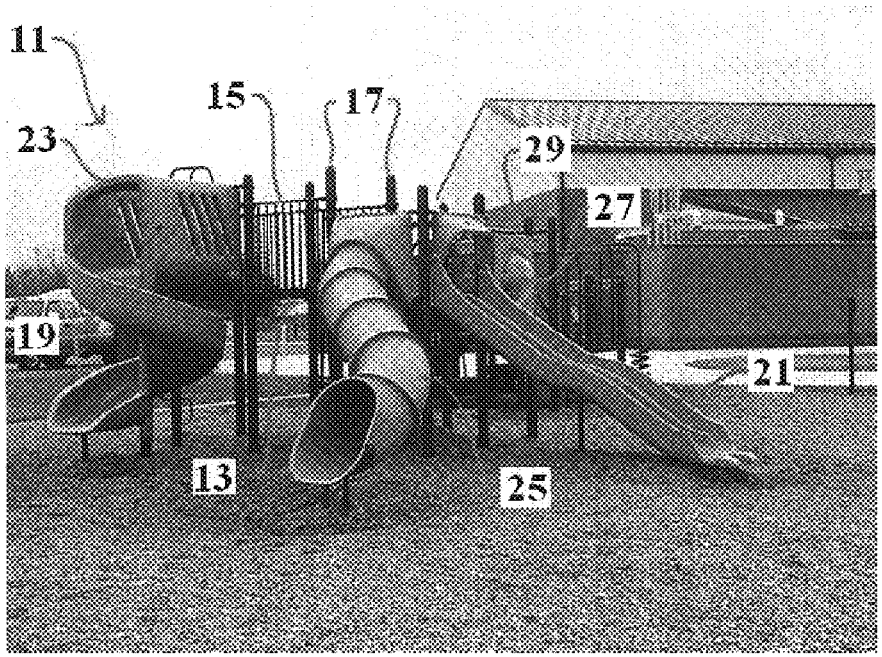
FIG. 1 is an illustration of a prior art playground structure.
Figure 2:
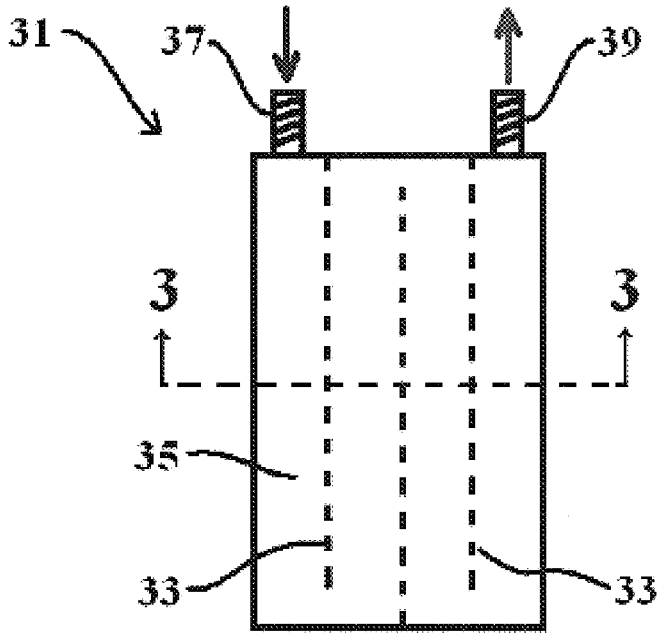
FIG. 2 is a top view of a component of a playground structure made in accordance with the teachings herein.
Figure 3:
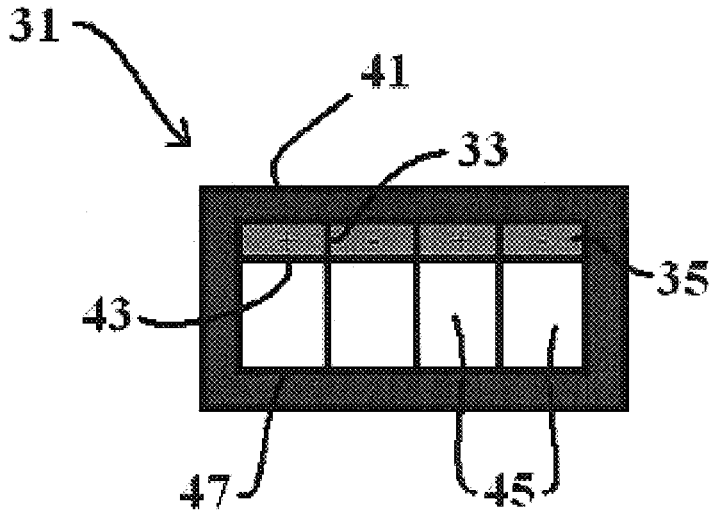
FIG. 3 is a cross-section taken along LINE 3—3 of FIG. 2.

FIGS. 2–3 illustrate one embodiment of a component 31 of a playground structure made in accordance with the teachings herein. The component has a series of internal baffles 33 that define a channel 35 for the flow of a coolant through the component. The channel is in open communication with an inlet 37 and an outlet 39 for directing coolant into and out of the channel, respectively. The channel is disposed within the component adjacent to the playing surface 41 thereof for the transfer of heat between the playing surface and the coolant. The direction of flow of the coolant is indicated by the arrows in FIG. 2 and by the +(flow coming out of the page) and −(flow going into the page) signs in FIG. 3.

In some embodiments, the materials of the component may be adapted to facilitate heat transfer between the coolant and one or more surfaces of the component. This may be accomplished, for example, through the use of appropriate fillers, through the selection of materials having inherently good thermal conductivities, through appropriate selection or modification of the physical properties and morphology of a polymeric material, or through various combinations of the foregoing.

One class of materials that can be used in the structures described herein to impart good thermal conductivity properties are gap filling materials such as the liquid gap filling materials sold under the trade name GAP FILLER™ 1000 by The Bergquest Co., Chanhassen, Minn. The later materials are available as two-component curing systems that provide a gel-like modulus and a good compression set. These materials are reported as having thermal conductivities of 1.0 W/mK. Various thermally conductive epoxies and elastomers are also known to the art which may be used to produce components made in accordance with the teachings herein that have suitable thermal conductivities.

A further class of materials that may be used in the structures of the present invention to provide good thermal conductivities are thermally conductive nanolaminates. One exemplary class of these materials are the thermally stable, layered, hexagonal ternary carbide and nitrides with the general formula MN+1AXN, where N=1 to 3, M is an early transition metal, A is an A-group (mostly IIIA and IVA) element, and X is either C and/or N. Typically, these materials have a structure in which XTi6 layers are separated from each other by layers of pure A.

In use, a sufficient flow of coolant is established through the component to maintain the surface temperature of the playing surface within an ergonomically acceptable range. Preferably, the ergonomically acceptable range will include a maximum temperature which is below those set by common safety standards. Thus, for example, EN 563, which is a safety standard promulgated by the European Association for the Co-Ordination of Consumer Representation in Standardization, has set a maximum safety temperature of 69° C. (156° F.) for plastic surfaces which will come into contact with human skin for a minimum of 10 seconds, and 74° C. (165° F.) for plastic surfaces which will come into contact with human skin for a minimum of 4 seconds. Since human skin burns if it attains a temperature of 43° C. (109° F.), it is even more preferred that a sufficient flow of coolant is established through the component to maintain the surface temperature of the playing surface below this temperature. Most preferably, a sufficient flow of coolant is established through the component to maintain the surface temperature of the playing surface below about 37° C. (100° F.).

In the particular component illustrated in FIGS. 2 and 3, the inlet and outlet are disposed on the same side of the component and consist of threaded nozzles.

Consequently, the coolant enters and leaves the component from the same side. This type of set-up is convenient for terminal components of playground structures, such as slides, where it may be desirable to route the coolant back in the direction it came from for further use or processing. However, various embodiments of components are possible in accordance with the teachings herein in which the coolant enters and leaves the component from opposite sides.

Figure 4:
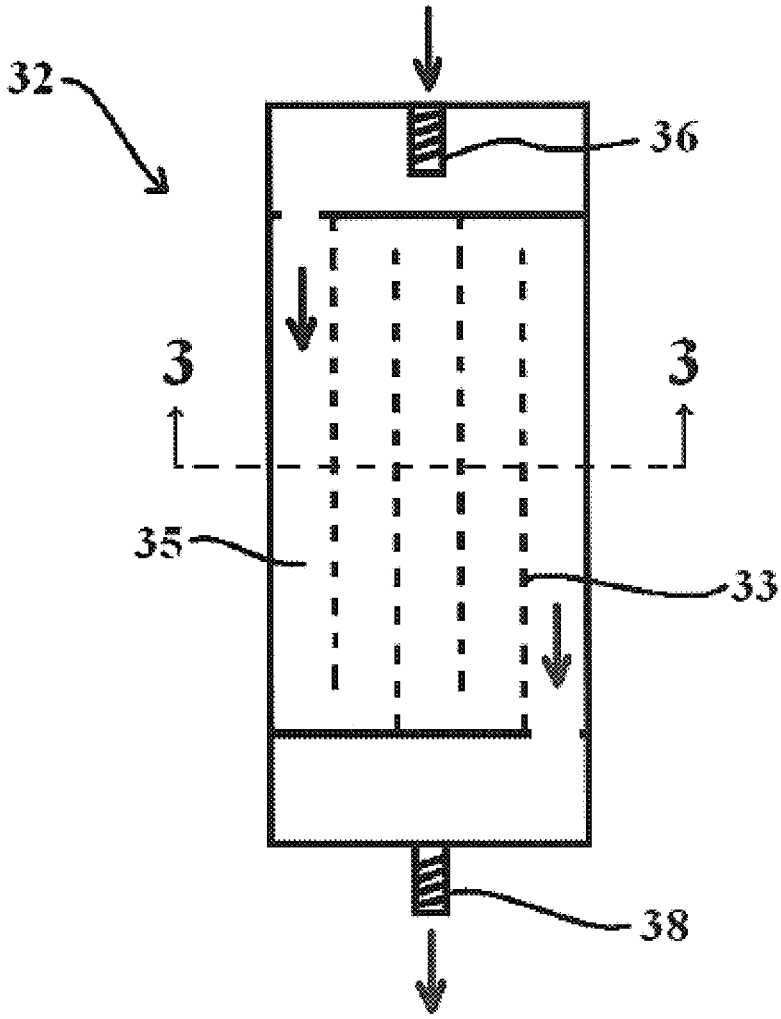
FIG. 4 is a top view of a component of a playground structure made in accordance with the teachings herein.

Thus, for example, FIG. 4 illustrates an embodiment of a component 32 of a playground structure which is similar to that depicted in FIGS. 2–3, except that the inlet 36 and outlet 38 are disposed on opposing sides of the component. The outlet 38 in this particular embodiment is a threaded nozzle similar to that employed in the embodiment of FIG. 2, and the inlet 36 is a threaded aperture adapted to mate with a threaded nozzle on an adjoining component so as to form a fluid-tight seal between the two components. Either or both of the nozzles and apertures may be provided with a means for rotating the same so as to achieve a fluid-tight seal, and the surface of the component in the vicinity of the nozzles and/or apertures may be recessed slightly to permit the use of a wrench or other tool for this purpose. These nozzles or apertures may further be fitted with washers, fluoroelastomeric pipe tape such as that sold under the trademark Teflon®, or other such products or devices that aid in the formation of a fluid-tight seal. Of course, it will be appreciated that a wide variety of mechanisms and devices besides nozzles and apertures may be used in playground structures made in accordance with the teachings herein to transfer coolant between adjacent components. Hence, components made in accordance with the teachings herein should not be construed as being limited to the use of these features.

Figure 5:
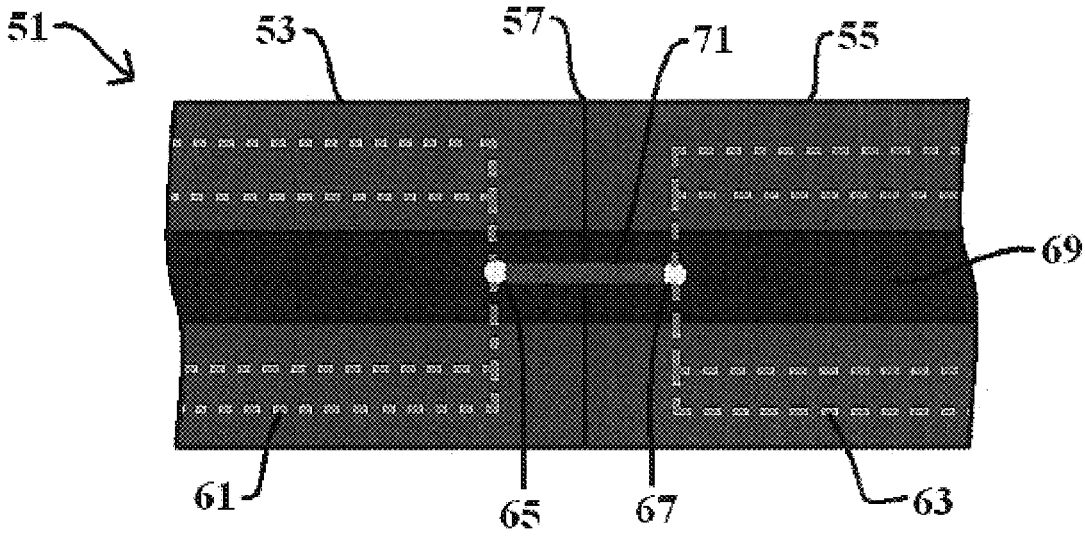
FIG. 5 is a bottom view of two adjacent components of a playground structure made in accordance with the teachings herein, and illustrating one possible method of joining together the heat exchange systems of adjacent components.
Figure 6:
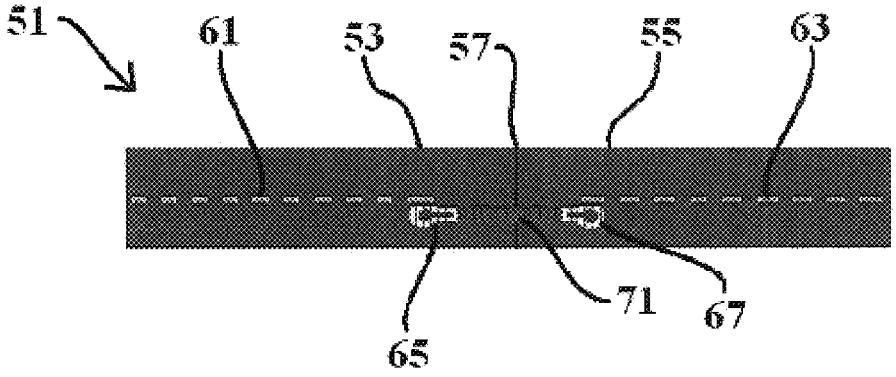
FIG. 6 is a side view of the adjacent components of FIG. 5.

FIGS. 5 and 6 depict an assembly having an alternative mechanism for transferring coolant between adjacent components in playground structures made in accordance with the teachings herein. In the arrangement 51 depicted therein, first 53 and second 55 components are joined together across an interface 57. The first and second components have first 61 and second 63 channels defined therein for the flow of coolant. The first and second channels are in open communication with first 65 and second 67 nozzles that extend parallel to the major surfaces of the first and second components. The first and second nozzles are disposed in a longitudinal groove 69 that extends the length of the first and second components, and are connected by a portion of flexible tubing 71 that is likewise disposed in the longitudinal groove. The longitudinal groove makes the assembly more aesthetically pleasing by hiding the first and second nozzle and the flexible tubing, while also affording some modicum of physical protection to these items. In use, the coolant flows through the first channel of the first component, exits through the first nozzle and into the second nozzle by way of the flexible tubing, and enters the second component.

The first and second nozzles may have threaded bases that screw into complimentarily threaded apertures disposed in the first and second components, and may also have a threaded spout that grips the inner surface of the flexible tubing. Nozzles of this type are commonly used in household irrigation systems and are available commercially from, for example, Rainbird Corporation, Azusa, Calif. Typically, these nozzles are made out of a plastic such as polyvinyl chloride. Suitable tubing includes, for example, polyethylene tubing such as that sold under the trade name Funny Pipe® by Toro Corporation, Bloomington, Minn.

Turning again to the embodiments depicted in FIGS. 2–4, it will be appreciated that the dimensions of the channels in these embodiments may vary, but will preferably be sufficiently large so that the channel will not clog easily if sand, dirt and other commonly encountered contaminants are introduced into it. It is also preferred that the dimensions of these channels be sufficiently large so that an adequate flow of fluid can be maintained in the channel as required to achieve a proper degree of heat transfer. On the other hand, it is preferred that the channel is not so large as to cause an excessive increase in the weight of the component by virtue of the volume of coolant circulating through it.

In the component depicted in FIG. 3, it is seen that the vertical walls defining the baffles 33 continue below the horizontal wall 43 defining the lower surface of the channel 35 and extend to the bottom 47 of the component 31. Hence, these vertical walls serve the additional purpose of adding structural integrity to the component. Preferably, the spaces 45 defined by the horizontal wall 43 and the bottom 47 are open to reduce the overall weight of the component and to reduce material consumption. However, in some embodiments, the horizontal wall 43 and the bottom 47 may be merged so that the channel 35 extends through the entire interior of the component.

Figure 7:
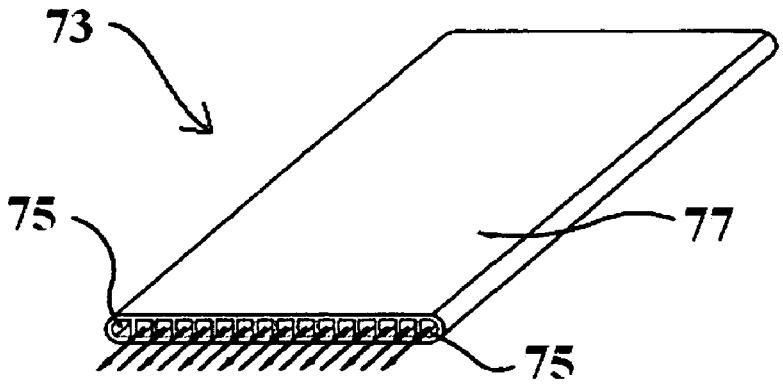
FIG. 7 is a perspective view of a component of a playground structure made in accordance with the teachings herein.
Figure 8:
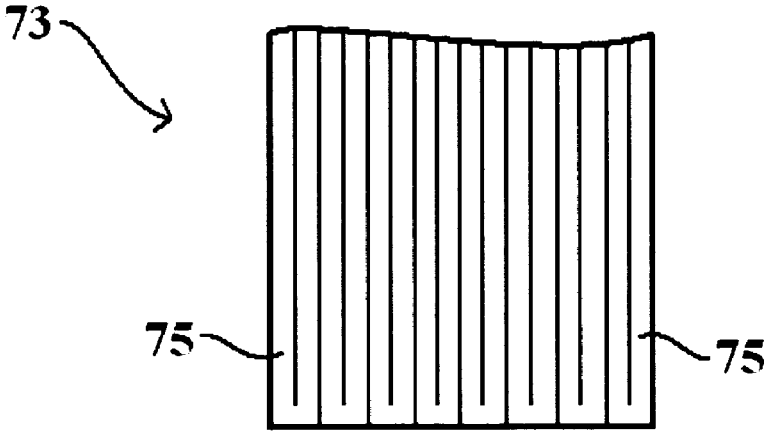
FIG. 8 is a top view (with the playing surface removed) of a terminal portion for a component of the type depicted in FIG. 7.

An example of this latter type of embodiment is shown in FIG. 7. In the component 73 depicted therein, a series of parallel channels 75 extend through the middle of the component adjacent to the playing surface thereon 77 with the direction of flow between any two adjacent channels being in the opposite direction. The component of FIG. 7 may be terminated as shown in FIG. 8 (the playing surface has been removed from this figure to reveal the channel structure) such that the flow of coolant in a particular channel is returned through an adjacent channel.

Figure 9:
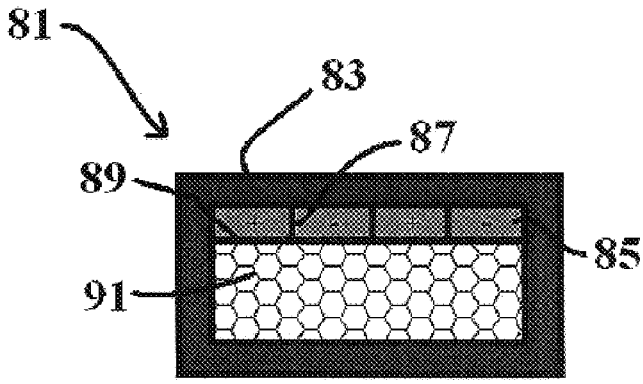
FIG. 9 is a cross-sectional view of a component of a playground structure made in accordance with the teachings herein.

With reference again to FIG. 3, it is again noted that the spaces 45 defined by the horizontal wall 43 and the bottom 47 in that embodiment are left empty to reduce the overall weight of the component. However, in other embodiments, these spaces may be filled with materials, such as, for example, cellular plastics, foams, or cellular concrete, that provide additional strength to the component at a low weight penalty. One non-limiting example of such an embodiment is shown in FIG. 9. The component 81 illustrated therein has a playing surface 83 with a channel 85 defined underneath it by a series of baffles 87 for the flow of a coolant. However, the walls defining the baffles do not extend beneath the horizontal wall 89 defining the bottom of the channel as in the embodiment depicted in FIG. 3. Rather, the space beneath the channel is occupied by a series of walls 91 having a honeycomb structure when taken in a cross-section along a plane perpendicular to the direction of flow of the coolant. Such a honeycomb structure significantly improves the structural integrity and load bearing capacity of the component, without unduly increasing the weight of the component.

Figure 10:
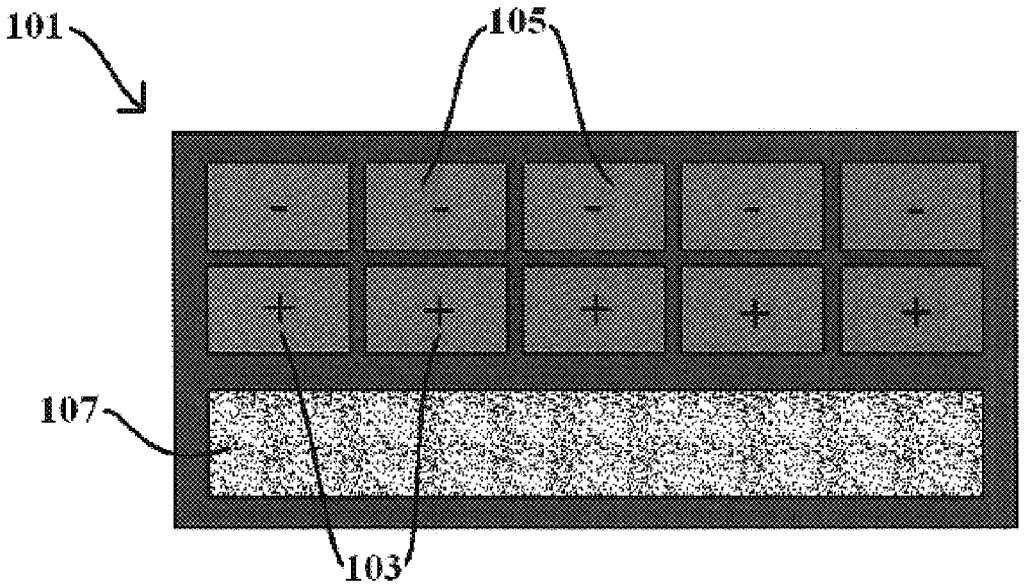
FIG. 10 is a cross-sectional view of a component of a playground structure made in accordance with the teachings herein.
Figure 11:
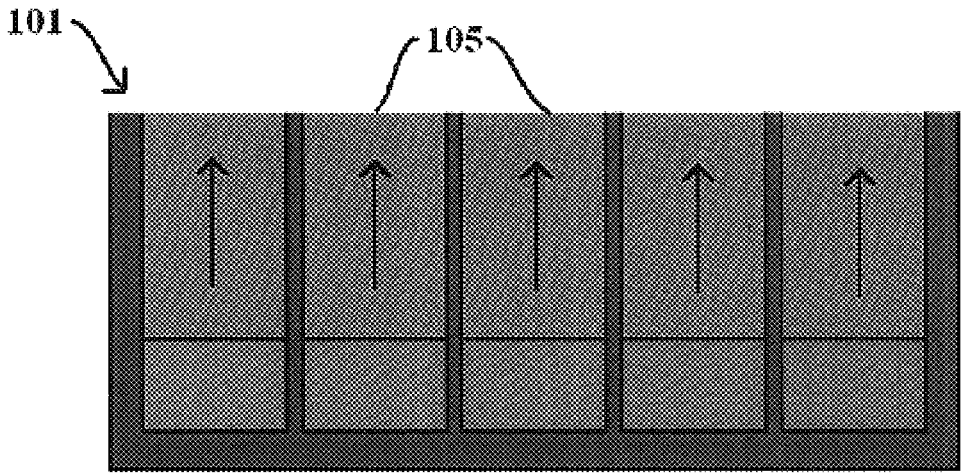
FIG. 11 is a top view (with the playing surface removed) of a terminal portion for a component of the type depicted in FIG. 10.

The components specifically illustrated thus far for playground structures made in accordance with the teachings herein have featured a single channel or a single set of parallel channels for the flow of coolant beneath the playing surface of the component. However, embodiments are also possible which employ more than one set of channels. One such embodiment is depicted in FIGS. 10–11. In the component 101 depicted therein, a first series of parallel channels 103 are provided for the flow of coolant into the component, and a second series 105 of channels are provided for the flow of coolant out of the component. The portion of the component beneath the channel is provided with a microcellular material 107 to reduce the weight of the component while improving the mechanical strength thereof.

Figure 12:
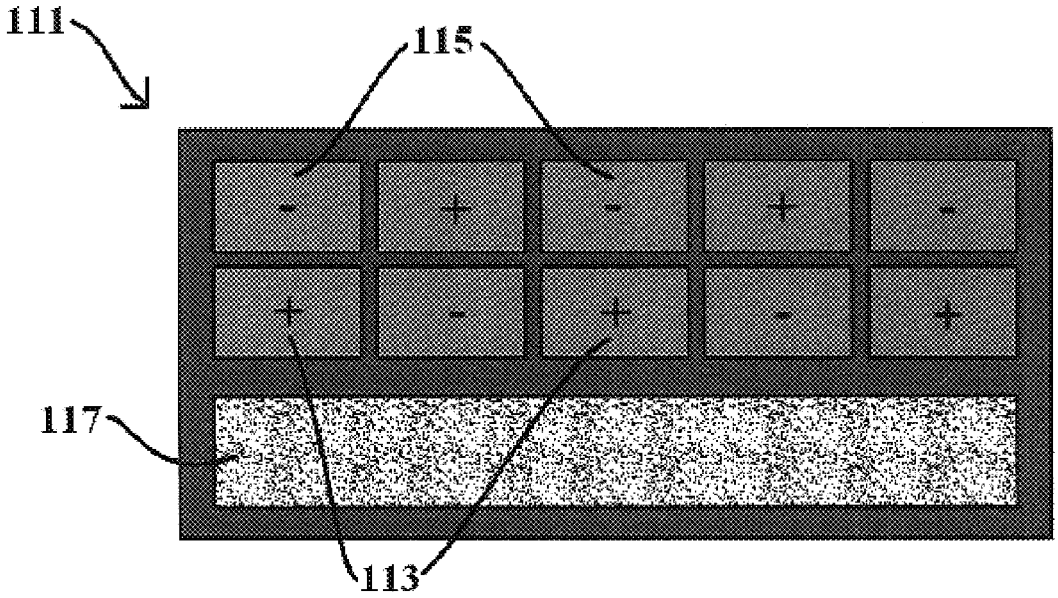
FIG. 12 is a cross-sectional view of a component of a playground structure made in accordance with the teachings herein.

In FIGS. 10–11, the first series of parallel channels 103 and the second series of parallel channels 105 are disposed on the lower and upper level of the component, respectively. However, it will be appreciated that these channels may be disposed in various other configurations as well. Thus, in the component 111 depicted in FIG. 12, the first 113 and second 115 series of channels alternate on both the upper and lower level of the component.

Figure 13:
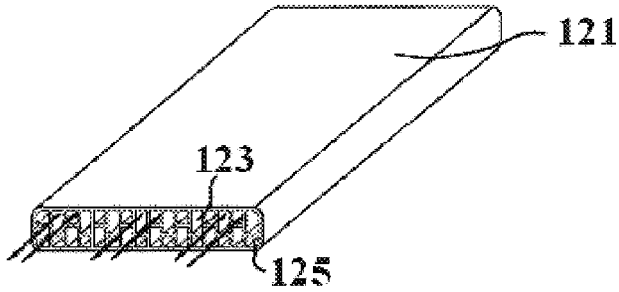
FIG. 13 is a perspective view of a component of playground structure made in accordance with the teachings herein.

It some embodiments of components made in accordance with the teachings herein, the dimensions of the channels are not the same on one or both levels. Thus, in the component 121 depicted in FIG. 13, the first 123 and second 125 series of channels alternate on both the upper and lower level of the component, but the first series of channels are larger than the second series of channels. Such embodiments may be advantageous in some applications in that the incoming coolant can be made to have a longer residence time in the component than the warmed outgoing coolant by virtue of the larger cross-sectional area of the (incoming) first series of channels and the corresponding differences in flow rates. It will be appreciated, however, that other mechanisms can be used to control the residence time of the coolant within the structure. Such mechanisms include, but are not limited to, pumps, valves, and other flow control devices. These mechanisms may be controlled by one or more timing or sensor devices that may be adapted to respond, for example, to the temperature of the coolant at one or more places in the structure and/or to ambient temperatures.

In the components depicted in FIGS. 2–13, the heat exchange system features a flow path consisting of a single channel (which may be convoluted, as in FIGS. 2–4) or a series of parallel channels (as in FIGS. 10–11). However, various other heat exchange set-ups may be employed in playground structures made in accordance with the teachings herein. These include, for example, core and shell type heat exchange systems, such as the system depicted in FIGS. 14–15.

Figure 14:
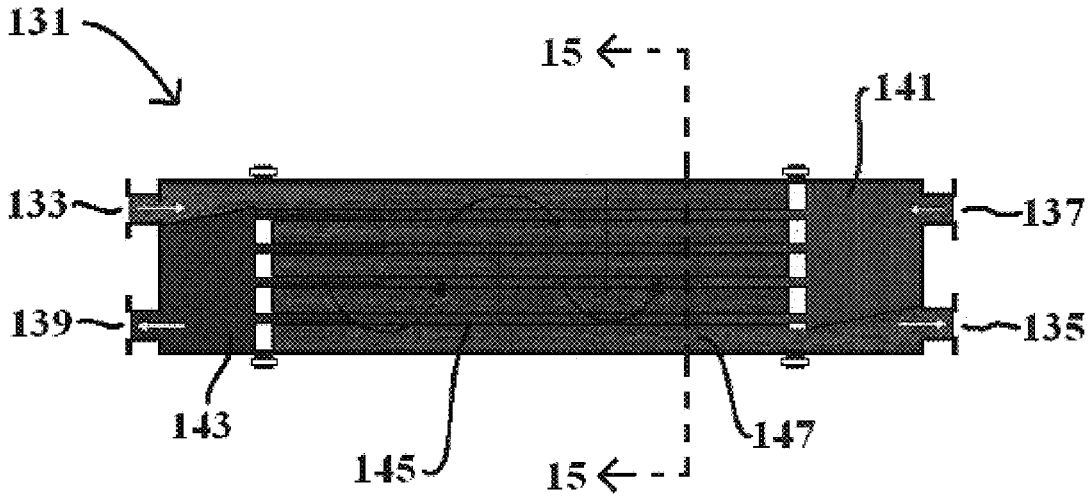
FIG. 14 is a top view (with the playing surface removed) of a component of a playground structure made in accordance with the teachings herein and having a core/shell heat exchange system.
Figure 15:
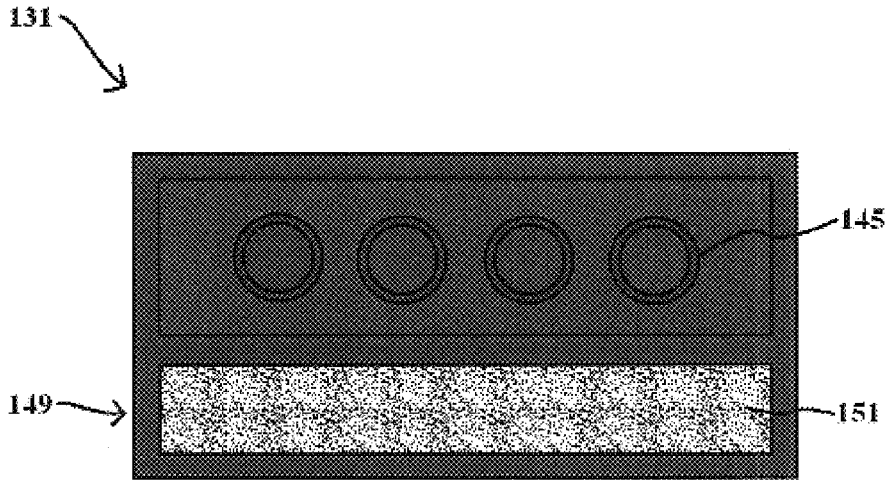
FIG. 15 is a cross-section taken along LINE 15—15 of FIG. 14.

The component 131 illustrated in FIGS. 14 and 15 is provided with a first inlet tube 133 and a first outlet tube 135 that are in open communication with each other and that have a first flow path (indicated by the arrows in FIG. 14) defined between them. This flow path defines the shell of the heat exchange system. The component is further provided with a second inlet tube 137 and a second outlet tube 139 that are in open communication with each other and that have a second flow path defined between them which defines the core of the heat exchange system. The second flow path includes first 141 and second 143 reservoirs with a plurality of tubes 145 extending between them. The first flow path includes a series of baffles 147 which direct a first, typically cooler fluid in a sinusoidal motion around the plurality of tubes, while a second, typically warmer fluid flows along the second flow path and through the tubes. The baffles serve to make the first flow path more convoluted, thus increasing the effective path length of the first flow path (and thereby increasing the residence time of the first fluid) and improving the heat transfer between the first and second fluids.

As seen in FIG. 15, the plurality of tubes 145 are disposed within the first flow path so that essentially the entire surface area of the tubes are exposed to the coolant flowing along the first flow path, thereby allowing for efficient heat exchange between the coolant flowing along the first and second flow paths. Typically, the coolant flowing along the first and second flow paths will be the same, though the segregated structure of the heat exchange portions of this component make it possible to use diverse coolants in the first and second flow paths. Also, as with many of the other embodiments described herein, the bottom portion 149 of the component may be hollow, or may be provided with a cellular foam or plastic 151 to reduce the weight of the component and/or improve its mechanical strength and load-bearing capacity.

Figure 16:
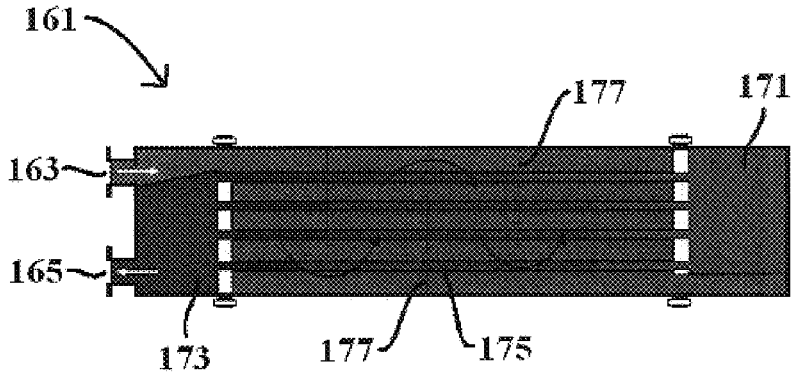
FIG. 16 is a top view (with the playing surface removed) of a component of a playground structure made in accordance with the teachings herein and having a core/shell heat exchange system.

FIG. 16 illustrates a component having a heat exchange system which is a variation of the system of FIGS. 14 and 15. The component 161 depicted in FIG. 16 is provided with an inlet tube 163 and an outlet tube 165 for the flow of coolant into and out of the component, respectively. As the coolant flows into the component, it follows a convoluted flow path (indicated by the arrows) defined by a series of baffles 177 that brings it into thermal contact with a series of tubes 169, after which the coolant enters a first reservoir 171. The coolant is then drawn from the first reservoir 171 into a second reservoir 173 by way of the tubes 169. This set-up allows the coolant to absorb heat from the playing surface (not shown) and from previously warmed coolant traversing the tubes, and may therefore improve the efficiency of the heat exchange system in some applications. The cross-section of the component of FIG. 16 in a direction orthogonal to the longitudinal axis and between adjacent baffles is similar to FIG. 15.

The various components described above have been depicted as rectangular slabs for ease of illustration and to facilitate comparison and contrast between the various embodiments. However, one skilled in the art will appreciate that the principles set forth herein can be readily applied to three-dimensional components of almost any shape and dimensions.

FIG. 17 depicts one possible embodiment of a playground structure 201 made with components of the type described above. The particular structure depicted utilizes water as the coolant which is supplied from a garden hose 203. The garden hose is connected to an underground water line 205, which in turn is connected to an inlet (not shown) set in a post 207 of the structure. The inlet is in open communication with a series of channels 208 that extend through the various components of the structure and cool the playing surfaces thereof.

The flow of water in the garden hose may be activated manually to provide a convenient means to cool the structure whenever the surfaces thereof become heated. The garden hose may also be set on a timer or other such device so that the playground structure will be cooled at predetermined intervals or times, or the playground structure may be equipped with a thermostat or other such device which triggers the flow of water under certain conditions (e.g., when one or more of the playing surfaces exceeds a strike temperature, or when the temperature of the coolant in one or more of the components exceeds a strike temperature).

When the flow of water in the garden hose is activated, the water flows through the hose 203, into the underground water line 205, and then into the various components of the playground structure as described above by way of the post 207. In the particular embodiment depicted, the water flows through a slide 209, first 211 and second 213 decks, and a stairway 215, after which it exits the structure by way of first 217 and second 219 shower heads. Hence, the structure combines the cooling functionality with one of the interactive features of the structure. In other embodiments, however, the flow of water through the shower heads is segregated from the flow of water through the components of the playground structure to avoid the possibility of scalding. This may be accomplished, for example, through the use of one-way valves or other mechanisms that divert a portion of the water flowing into the structure to the shower heads. This may also be accomplished by providing a separate water supply to the shower head.

It will be appreciated that, in the playground structure depicted in FIG. 17, the water could also be routed through the railings 221, bars 223, and other features or components of the structure. It will also be appreciated that the garden hose could be replaced with any other pressurized water source, including, for example, a standard household plumbing line or a water reservoir equipped with a pumping system equipped with one or more pumps. The system depicted in FIG. 17 may also be provided with drainage means so that water will drain adequately from components of the system. This later feature is especially desirable when the playground structure will be used in cold weather climates where freezing may occur.

FIG. 18 depicts another possible embodiment 231 of a playground structure made with components of the type described above. The embodiment of FIG. 18 is similar in many respects to that shown in FIG. 17. However, while the embodiment of FIG. 17 is depicted with a garden hose as the water supply, the embodiment of FIG. 18 utilizes a pump 233 to draw cool water from a reservoir 235 buried beneath the playground structure. The pump draws cool water through a series of intakes 237 and into the playground structure, where it comes into thermal contact with the playing surfaces of the structure, thereby cooling them. In the process, the water becomes heated. The heated water is returned to the reservoir, where it mixes with the cool water already present in the reservoir. The reservoir in this embodiment is preferably sized such that its heat capacity exceeds that required to maintain the playing surfaces of the playground structure within an ergonomically acceptable range.

While FIG. 18 depicts the reservoir as being disposed beneath the playground structure, one skilled in the art will appreciate that the reservoir could also be remote from the playground structure. One skilled in the art will also appreciate that the use of a reservoir external to the playground structure, while convenient in some applications and settings, is not necessary in all applications and settings. Hence, for example, in some embodiments, the playground structure itself may be provided with a temperature regulating means for mechanically heating and/or cooling a fluid, and such temperature regulating means may comprise one or more reservoirs internal to the structure. Thus, in a specific, non-limiting embodiment, the structure comprises one or more reservoirs built into the base of a slide. The temperature regulating means may be an integral component of the playground structure, and it may be disposed internally within the structure or may be attached directly to an exterior surface thereof.

Various coolants may be used in the playground structures described herein. Preferably, the coolant is water, which may optionally be treated with various materials, such as sodium chloride, calcium chloride, or various other inorganic or organic salts, to depress its freezing point. Other suitable coolants include commercially available coolants such as ethylene glycol, propylene glycol, and mixtures of the foregoing with each other and/or with water. Various fluorocarbons and perfluorocarbons may also be used. Moreover, while the use of liquid coolants is preferred, one skilled in the art will appreciate that, with suitable modifications, gaseous coolants may also be used in the structures described herein. In some embodiments, the coolant may exist as either a gas or a liquid or as both a gas and a liquid, depending on what part of the system the coolant is located and on such other factors as ambient temperature.

The coolants used in the playground structures described herein may also contain various other ingredients. Such other ingredients include dyes, surfactants, viscosity modifiers, detergents, lubricants, antibacterial or antimicrobial agents, and the like. The coolant may also include a material that provides a visual or sensory indicator, such as a color or smell, if there is a leak in the system.

The playground structures described herein have been explained primarily in reference to integrated playground structures and components thereof. However, it will be appreciated that the principles disclosed herein may also be applied to stand-alone playground structures, such as isolated slides, climbing bars, and the like.

Moreover, while the heat exchange systems disclosed herein have been described primarily with reference to systems that act to cool a playing surface, one skilled in the art will appreciate that heat exchange systems may also be incorporated into playground structures made in accordance with the teachings herein wherein the heat exchange system acts to modify the surface temperature of a playing surface, by cooling and/or heating that surface.

One skilled in the art will further appreciate that the principles disclosed herein may be extended to various other outdoor structures besides playground structures. Non-limiting examples of such other structures include, for example, outdoor furniture (such as, for example, park benches, picnic tables and chairs), outdoor fitness structures (such as, for example, sit-up inclines), water craft, and pool decking. In the case of pool decking, in some embodiments, a system can be implemented wherein water is drawn from the pool (e.g., at or near the bottom of the pool where the water is typically cooler) and pumped through the pool decking using the methodologies described herein. The water can then be returned to the pool, with or without cooling.

The above description of the invention is illustrative, and is not intended to be limiting. It will thus be appreciated that various additions, substitutions and modifications may be made to the above described embodiments without departing from the scope of the present invention. Accordingly, the scope of the present invention should be construed solely in reference to the appended claims.

What is claimed is:

1. A playground structure, comprising:

a body having a playing surface thereon;

a plurality of posts supporting said body above the ground;

at least one channel extending through said body, said channel being adapted to transfer heat from said playing surface to a fluid disposed in said channel;

a fluid inlet in fluidic communication with said channel;

a fluid outlet in fluidic communication with said channel;

a source of fluid; and a first conduit which is in fluidic communication with said fluid inlet and said source.

2. The playground structure of claim 1, wherein said source of coolant is a garden hose.

3. The playground structure of claim 1, wherein said source of coolant is an underground reservoir.

4. The playground structure of claim 3, further comprising a second conduit for transferring fluid from said playground structure to said reservoir.

5. The playground structure of claim 1, further comprising a pump for pumping fluid from said reservoir to said playground structure.

6. A playground structure, comprising:

a first deck member comprising a first deck surface, a first fluid inlet, a first fluid outlet, and a first convoluted channel disposed within said first deck member which is in fluidic communication with said first inlet and said first outlet, said first channel being adapted to transfer heat between said first deck surface and a fluid flowing through said first channel;

a second deck member comprising a second deck surface, a second fluid inlet, a second fluid outlet, and a second convoluted channel disposed within said second deck member which is in fluidic communication with said second inlet and said second outlet, said second channel being adapted to transfer heat between said second deck surface and a fluid flowing through said second channel, and wherein said second fluid inlet is in fluidic communication with said first fluid outlet;

a plurality of posts supporting said first and second deck members above the ground;

a source of coolant; and a first conduit for transferring fluid from said source of coolant to said first fluid inlet.

7. The playground structure of claim 6, wherein said source of coolant is a garden hose.

8. The playground structure of claim 6, wherein said source of coolant is an underground reservoir.

9. The playground structure of claim 8, further comprising a second conduit for transferring fluid from said playground structure to said reservoir.

10. The playground structure of claim 6, wherein the fluid outlet of the first deck member comprises a first threaded nozzle, wherein the fluid inlet of the second deck member comprises a second threaded nozzle, and where the first and second threaded nozzles are in fluidic communication with each other by way of a portion of flexible tubing having a first end which extends over the first threaded nozzle, and having a second end which extends over the second threaded nozzle.

11. The playground structure of claim 6, wherein the deck surface of said first and second deck members is plastic.

12. The playground structure of claim 6, wherein said coolant is water.

13. The playground structure of claim 6, wherein said first channel is adjacent to said first deck surface.

14. The playground structure of claim 6, wherein said first outlet and said second inlet are connected via a portion of tubing.

15. The playground structure of claim 14, wherein said first and second deck members are equipped with first and second adjoining longitudinal grooves, and wherein said first outlet and said second inlet are disposed within said first and second longitudinal grooves, respectively.

16. A method for controlling the temperature of a playing surface on a playground structure, comprising the steps of:

providing a component for a playground structure, the component comprising (a) a body having a playing surface thereon, (b) a plurality of posts supporting the body above the ground, (c) at least one channel extending through the body, the channel being adapted to transfer heat from the playing surface to a fluid disposed in the channel, (d) a fluid inlet in fluidic communication with the channel, and (e) a fluid outlet in fluidic communication with the channel;

providing a source of fluid;

providing a conduit which is in fluidic communication with the fluid inlet and the source;

monitoring the temperature $T_{ps}$ of the playing surface; and while $T_{ps}>T_k$, where $T_k$ is a predetermined strike temperature, directing a fluid from the source through said channel.

17. The method of claim 16, wherein the temperature $T_{ps}$ of the playing surface is monitored by monitoring the temperature of a fluid flowing through the channel.

18. The method of claim 16, wherein the component further comprises (c) an inlet adapted to direct a fluid into said at least one channel, and (d) an outlet adapted to direct a fluid out of said at least one channel.

* * * * *